US005318476A

United States Patent [19]

Haskayne et al.

[11] Patent Number: 5,318,476

[45] Date of Patent: Jun. 7, 1994

[54] RECORD PADS

[75] Inventors: Jo Ann Haskayne; Victor H. Perriman, both of London, England

[73] Assignee: Moore Business Forms, Inc., Grand Island, N.Y.

[21] Appl. No.: 772,418

[22] Filed: Oct. 7, 1991

[51] Int. Cl.[5] ..... B42D 15/00

[52] U.S. Cl. ..... 462/8; 462/9; 462/18; 462/19; 462/23; 462/57; 462/58; 462/84

[58] Field of Search ..... 462/84, 8, 9, 18, 19, 462/23, 57, 58

[56] References Cited

U.S. PATENT DOCUMENTS

| | | | |
|---|---|---|---|
| 3,981,523 | 9/1976 | Maalouf | 282/27.5 |
| 4,126,334 | 11/1978 | Van Malderghem | 282/22 R |
| 4,199,174 | 4/1980 | Sornberger | 282/27.5 |
| 4,533,160 | 8/1985 | Malone | 282/23 R |
| 4,590,109 | 5/1986 | Holmberg | 428/40 |
| 4,714,276 | 12/1987 | Greig | 283/63 R |
| 4,798,401 | 1/1989 | Greig | 282/9 R |
| 4,934,740 | 6/1990 | Drake | 282/8 R |

FOREIGN PATENT DOCUMENTS

| | | |
|---|---|---|
| 0325057 | 7/1989 | European Pat. Off. . |
| 5441329 | 8/1977 | Japan . |
| 5772470 | 10/1980 | Japan . |
| 452479 | 5/1968 | Switzerland . |
| 909548 | 10/1962 | United Kingdom . |
| 981808 | 1/1965 | United Kingdom . |
| 1120539 | 7/1968 | United Kingdom . |
| 1316792 | 5/1973 | United Kingdom . |
| 2052435 | 1/1981 | United Kingdom . |
| 2214131 | 8/1989 | United Kingdom . |

*Primary Examiner*—Paul A. Bell
*Attorney, Agent, or Firm*—Nixon & Vanderhye

[57] ABSTRACT

A record pad of paper sheets includes a number of stacked sets of sheets. Each set comprises a quadrate top sheet having top and bottom faces and for receiving indicia on its top face and having a first edge; a quadrate record sheet having top and bottom faces and for receiving transferred indicia from the top sheet on its top face, and having a first edge extending generally parallel to and outwardly from the first edge of the top sheet to define a margin; a transfer mechanism (such CF and CB constructions) is disposed between the top and record sheets for transferring indicia from the top sheet to the record sheet; and repositionable adhesive is provided on the top sheet bottom face at the top sheet first edge for releasably connecting the top sheet to the record sheet. The pad also includes mechanical fastener or adhesive for securing the record sheets in the pad of stacked sheets together at the margins. A writing shield for disposition between the bottom face of record sheets and the top face of top sheets of adjacent stacked sets of the pad for isolating a top set from the rest of the sets to prevent image transfer, is also provided; the shield may be integral with a backing for the pad, which in turn may be integral with a cover. A third sheet, with associated transfer mechanism, may be provided in each set beneath the record sheet, and three pads may be arranged in a "three to view" format connected together by a common mechanical securing mechanism.

20 Claims, 2 Drawing Sheets

RECORD PADS

BACKGROUND AND SUMMARY OF THE INVENTION

This invention relates to record pads having repositionable adhesive on the back of each sheet in the pad.

In recent years pads of paper in which each sheet has a marginal stub area bearing on its underside a band of non-drying, slightly-tacky adhesive which, while permanently bonded to the underside of the sheet, only temporarily bonds to other surfaces, including to the stub areas of the top surfaces of respectively adjacent like sheets in the stack which constitutes the pad, have become very popular.

The general concept of such a product is disclosed in the Swiss Patent of Eugster 452,479 dated 31 May 1968.

Eugster discloses a paper pad that is composed of self-adhesive individual sheets and is characterized in that each sheet is detachably joined to the sheet underneath it by means of a non-drying adhesive and in that the strip of adhesive provided at the edge of each individual sheet has one side which is smooth and adherent but does not take up adhesive while the other side carries the adhesive. The side carrying the adhesive may be arranged on the underside of the sheet. The adhesive applied to this side cannot be removed without chemical agents. When two such surfaces of adhesive strip which have been glued together are separated, virtually all the adhesive is left on the underside while the upper surface remains unwetted.

When assembling such a pad with the aid of non-drying adhesive the top edge of each individual sheet is mechanically pressed with its underside, which receives adhesive, to the smooth upper surface of the other sheet, which does not take up adhesive. The individual sheets are thereby bonded together but they are not permanently fixed together; that is to say, they are not glued together but can be separated one by one by hand. When a sheet is removed, the adhesive is left on the underside of the sheet so that the sheet which has been removed can be fixed by light finger pressure to another surface without the use of fresh adhesives.

Adhesives and paper useful in making such products are well known in the particular area.

It is also known to provide multiple sheet forms with carbonless coating for producing multiple copies of an original writing and reference may be made by way of example to U.S. Pat. Nos. 3,981,523; 4,126,334 and 4,199,174.

British Patent Specification No. 2,214,131 describes a pad with record sheets and removable sheets disposed in pairs. Transfer material is positioned between the record sheet and the removable sheet of each pair and a strip of low tack adhesive is provided along the marginal edge of the removable sheet with a perforation line in the removable sheet within the strip of low tack adhesive.

U.S. Pat. No. 4,934,740 relates to a multi-sheet pad with repositionable adhesive on the top pad, with a perforation for connecting common margins of both the top and record sheets of the pad together. U.S. Pat. No. 4,714,276 shows a multi-sheet pad with release adhesive disposed at different points along the pad, and with marginal tabs extending beyond the edges of adjacent sheets. There is no connection at the marginal tabs, however, but rather the sheets are connected together by adhesive at the opposite end of the pad from the marginal tabs. U.S. Pat. No. 4,798,401 provides a pad with repositionable adhesive in a carbonless imaging system but there are no outwardly extending margin areas that are fastened together.

According to the invention, an improved record pad is provided. The improved record pad is made up of a plurality of sets of sheets in which a message or other data may be applied to the top sheet of the set and a copy of the message or other data made on the underlying record sheet, and in which the top sheet of the set may be detached leaving the record copy sheet remaining.

According to the present invention a record pad comprises a plurality of sheet sets, each set comprising at least a removable top copy sheet and an underlying record copy sheet in which the top copy sheet lies in close juxtaposition on the underlying record copy sheet and bears a strip of repositionable adhesive adjacent an edge of the record copy sheet and in which the record copy sheet extends beyond the edge of the top copy sheet to provide a margin which margin serves to be secured to other margins of the pad for record purposes.

It is a primary object of the present invention to provide a simple yet effective pad with bound record sheets, and top sheets with release adhesive. This and other objects of the invention will become clear from an inspection of the detailed description of the invention, and from the appended claims.

DETAILED DESCRIPTION OF THE DRAWINGS

Figure 1:
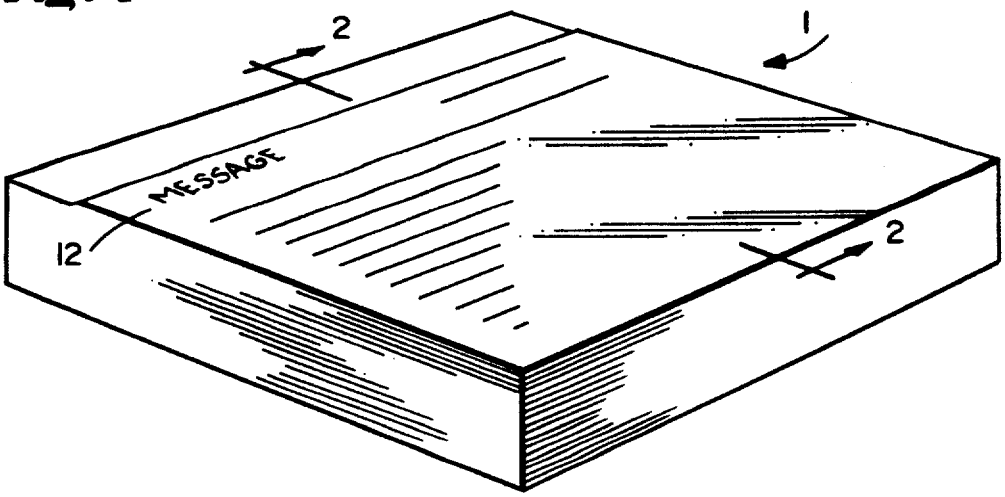
FIG. 1 is a perspective view of a first exemplary embodiment of record pad in accordance with the invention.
Figure 2:
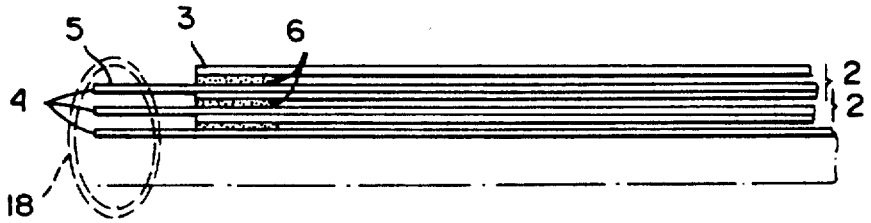
FIG. 2 is a sectional view along the line 2—2 of FIG. 1.
Figure 3:
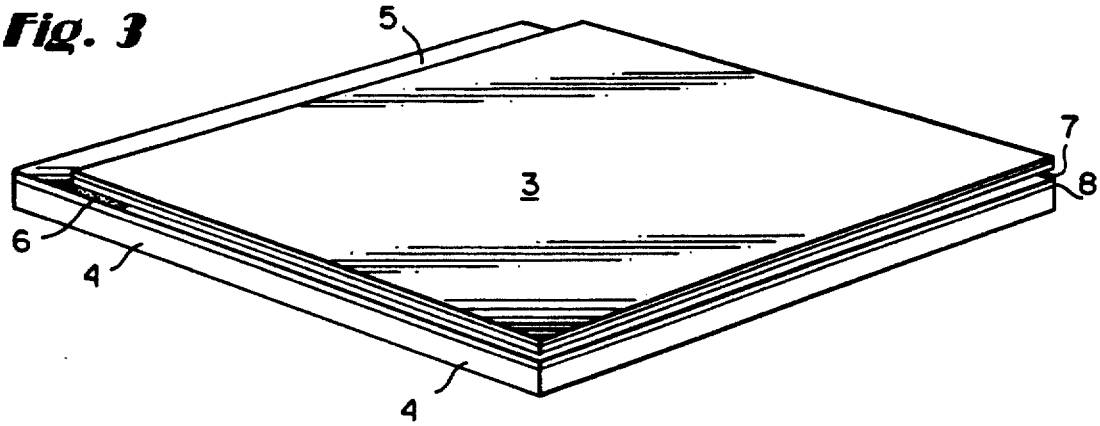
FIG. 3 is an exaggerated perspective view of a single set of the pad of FIG. 1.

Referring to FIGS. 1, 2 and 3, a record pad 1 comprises a plurality of paper sheet sets 2 arranged in close juxtaposition. Each sheet set comprises a removable quadrate top copy sheet 3 and an underlying quadrate record copy sheet 4. The relative arrangement of removable top copy sheet and underlying record copy sheet is best shown in FIG. 3, although in practice it is not intended that the record pad will comprise a single set.

The underlying record copy sheet 4 which bears no tear off perforations extends beyond the edge of the top copy sheet 3 to provide a margin 5 which margin serves as a means to secure the underlying record copy sheet together with securing means. Such securing means may comprise a strip of permanent adhesive 17 (see FIG. 4) along the margin 5 of each record copy sheet 4 between adjacent record copy sheets 4, or it may comprise adhesive positioned along the outer edge of each record copy sheet 4. Other securing means, such as mechanical securing means 18 (see FIG. 2) like wire, staples, stitching, paper staples or mechanical binding as known in the art per se, may be used to secure the record copy sheets together.

Each top copy sheet 3 is secured to the record copy sheet underlying it by repositionable adhesive arranged in the form of a strip of such repositionable adhesive 6 adjacent the edge of the top copy sheet 3 adjacent the margin 5 and parallel to the edge of the top copy sheet 3. This repositionable adhesive 6 is arranged in such fashion that the top record copy sheet 3 is detachably joined to the underlying record copy sheet so that the sheet 3 may be removed from the underlying record sheet 4 and applied to another surface.

Also between each top copy sheet 3 and the complementary underlying record copy sheet 4 a transfer material coating 7, 8 (see FIG. 3) is provided to enable a message or other data applied to the top copy sheet 3 to be copied onto the underlying record copy sheet 4. Such transfer material coating may be of the kind sold under one of the Trade Marks MCP, Idem or Action and may be of the kind in which, as shown in FIG. 3, a donor coating 7 is applied to the underside of the top copy sheet 3 and an acceptor coating 8 is applied to the top side of the underlying record copy sheet 4, or preferably may be of the kind referred to as a self contained coating which coating is applied only to the top side of the underlying record copy sheet 4 or may be of the kind in which the image forming materials are incorporated into the paper when it is manufactured. It is preferred that the self contained coating be employed so that the adhesive can be applied to the lower uncoated side of each sheet. That is, sheets 3 may be CB sheets and sheets 4 CF sheets, or a self containing transfer coating may be applied to the top of each sheet 4.

The top copy sheet 3 may bear printed matter appropriate to the application for which the pad is to be used. Thus, if it is intended for use as a telephone message pad, the word "Message" may be printed on the top copy sheet 3 as shown at 12 in FIG. 1. Similar printing may be applied to the record copy sheet 4 as may be appropriate, but such sheet 4 need not bear corresponding printing.

Figure 5:
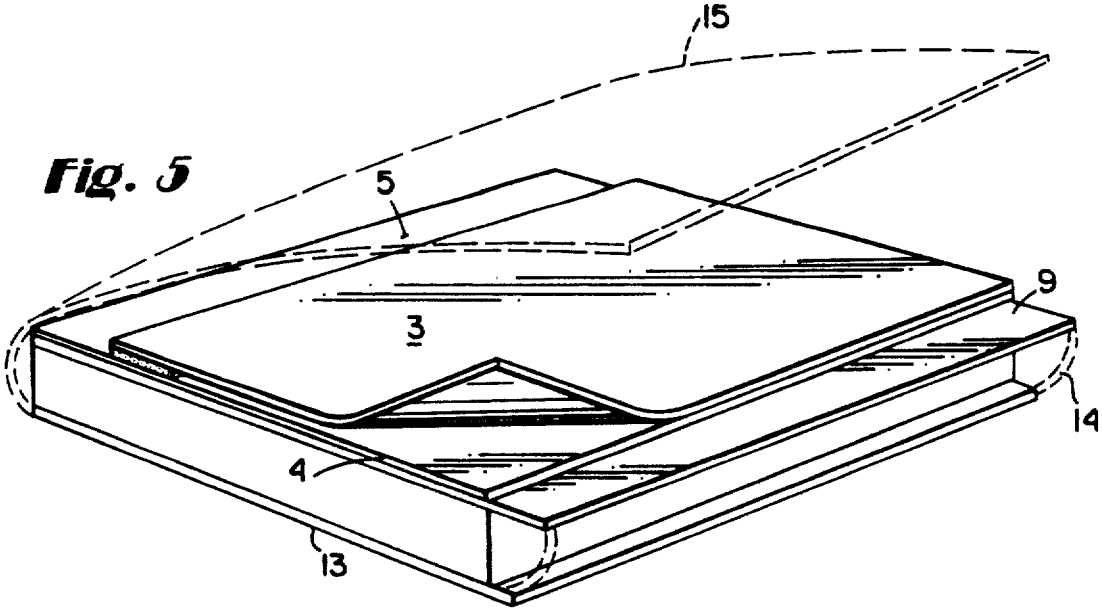
FIG. 5 is a schematic perspective view showing the pad of FIG. 1 in use with a writing shield.

Preferably a sheet of cardboard, paperboard or stiff paper 9 (see FIG. 5) may be associated with the pad so that the sheet 9 may be inserted between the uppermost sheet set 2 of the pad and the next succeeding set 2 of the pad to provide a writing shield. This is intended to prevent a message or data applied to the top set being duplicated on the underlying record copy sheet 4 of the record copy sheets of succeeding sets. Also, the pad may be provided with a cardboard, paperboard or stiff backing sheet 13 (see FIG. 5) associated with the sheet 9, which may be connected by an integral hinge 14 to shield 9. Also, a cover may be provided including a backing sheet 13 to lie beneath the lowermost set of the pad with one fold-over part 9 serving as a writing shield sheet and another fold-over part 15 (see FIG. 5) to serve as a cover sheet. The pad 1 may be temporarily removed from within the cover.

In use the pad 1 may be used as a telephone message pad. The pad is positioned on a firm surface and the sheet of cardboard 9 is inserted between the uppermost set 2 of the pad and the succeeding set 2 and a message is written on the removable top copy sheet 3. The message written on the sheet 3 is duplicated by the transfer material 7, 8 on the underlying record copy sheet 4. The removable top copy sheet 3 is then removed and placed in a position for the intended message recipient to read it and the copy sheet 4 remains secured to the other sheets of the pad as a record. It is preferably placed on a firm surface by the repositionable adhesive where it will remain until the message recipient deals with it and removes it.

Figure 4:
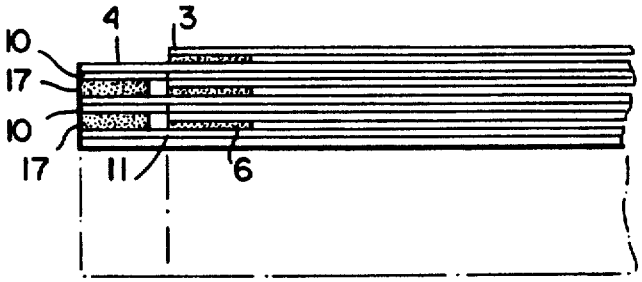
FIG. 4 is a sectional view similar to FIG. 2 of a second exemplary embodiment of a pad according to the invention.

Various modifications to the construction of the pad 1 may be made. Thus, as shown in FIG. 4, an additional copy sheet may be inserted in such set. underneath and in register with sheet 4 as the last sheet 10 of the set. For example, sheet 4 can be CFB sheet, and sheet 10 a CF sheet. A transverse line of weakness (e.g. perforation) 11 is provided in the sheet 10 to enable the body of the sheet 10 to be removed. This line of perforations 11 is provided adjacent the head of the sheet 10 preferably in line with and underlying the edge of the top copy sheet 3. Such a pad may be suitable for use, for example, in a take away restaurant in which information about a take away meal is applied to the top copy sheet 3. Such sheet is removed and applied to the container containing the take away meal and the detached copy sheet 10 may serve, for example, as a receipt for payment of the meal or sent to the kitchen of the take away restaurant as an instruction to prepare the meal. The record copy sheet 4 remains in the pad as a record.

Figure 6:
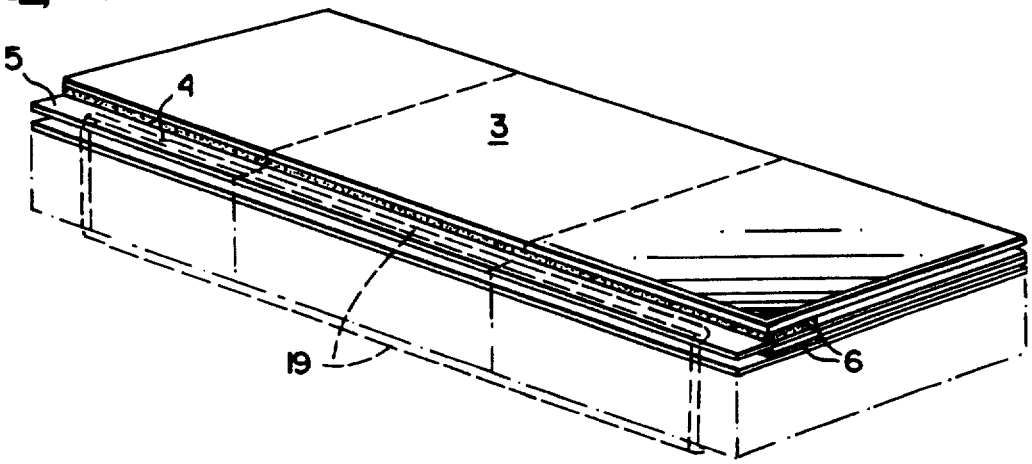
FIG. 6 shows a modification in which a number of pads of FIG. 1 are associated with each other.

If desired, the pad may comprise a series of record pads arranged side by side as shown in FIG. 6. The record pad comprises a "three to view" top copy sheets 3 with a "three to view" underlying record copy sheets 4 with strips of repositionable adhesive 6 between the top copy sheets 3 and the underlying record sheets 4 and transfer material 7, 8 (not shown) between the sheets 3 and 4. The underlying record copy sheets 4 extend beyond the top copy sheets 3 to form a margin 5 to provide a means for securing the record copy sheets together, together with a mechanical securing means 19.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A record pad of paper sheets comprising a plurality of stacked sets of sheets;

each set comprising: a quadrate top sheet having top and bottom faces and adapted to receive indicia on the top face thereof and having a first edge; a quadrate record sheet having top and bottom faces and adapted to receive transferred indicia from said top sheet on the top face thereof, and having a first edge extending generally parallel to and outwardly from said first edge of said top sheet to define a margin; transfer means operatively disposed between said top and record sheets for transferring indicia from said top sheet to said record sheet; and repositionable adhesive provided on said top sheet bottom face for operatively releasably connecting said top sheet to said record sheet; and securing means for securing said record sheets in said pad of stacked sheets together at said margins thereof.

2. A pad as recited in claim 1 wherein said repositionable adhesive is provided at said first edge of said top sheet in each set, and is connected directly to said record sheet top face.

3. A pad as recited in claim 2 further comprising a writing shield comprising a cardboard, paperboard, or stiff paper sheet for disposition between the bottom face of record sheets and the top face of top sheets of adjacent stacked sets of said pad for isolating a top set from the rest of the sets to prevent image transfer therebetween; a backing sheet for said pad, disposed below the lowermost set of said stacked sets, said backing sheet of cardboard, paperboard, or stiff paper, and connected by an integral hinge of cardboard, paperboard, or stiff paper to said writing shield.

4. A pad as recited in claim 3 further comprising a cover, for covering the top set of said pad, of cardboard, paperboard, or stiff paper, said cover connected to said backing sheet.

5. A pad as recited in claim 2 wherein said securing means is a mechanical securing means.

6. A pad as recited in claim 1 further comprising indicia printed on the top face of each of said top sheets.

7. A pad as recited in claim 1 further comprising a writing shield for disposition between the bottom face of record sheets and the top face of top sheets of adjacent stacked sets of said pad for isolating a top set from the rest of the sets to prevent image transfer therebetween.

8. A pad as recited in claim 7 wherein said writing shield comprises a cardboard, paperboard, or stiff paper sheet.

9. A pad as recited in claim 8 further comprising a backing sheet for said pad, disposed below the lowermost set of said stacked sets, said backing sheet of cardboard, paperboard, or stiff paper.

10. A pad as recited in claim 9 further comprising an integral hinge of cardboard, paperboard, or stiff paper connecting said writing shield and backing sheet together.

11. A pad as recited in claim 10 further comprising a cover for covering the top set of said pad.

12. A pad as recited in claim 11 wherein said cover is of cardboard, paperboard, or stiff paper, and is connected to said backing sheet.

13. A pad as recited in claim 1 wherein said transfer means is provided by providing said top sheet as a CB sheet, and said record sheet as a CF sheet.

14. A pad as recited in claim 1 wherein said transfer means is provided by providing a self contained transfer coating on the top surface of said record sheet.

15. A pad as recited in claim 1 wherein said securing means comprises mechanical securing means.

16. A pad as recited in claim 1 wherein said securing means comprises permanent adhesive.

17. A pad as recited in claim 1 wherein each set further comprises a third quadrate sheet having top and bottom faces and a first edge in alignment with the first edge of said record sheet; and second transfer means operatively disposed between the bottom face of said record sheet and the top face of said third sheet for transferring indicia from said record sheet to the top face of said third sheet; and wherein said securing means fastens said record and third sheets of all of the sets together.

18. A pad as recited in claim 17 further comprising a line of weakness formed in each of said third sheets adjacent and parallel to the first edge of said top sheet of the next set of stacked sets.

19. A pad as recited in claim 18 wherein said transfer means and said second transfer means are provided by providing said top sheet in each set as a CB sheet, said record sheet as a CFB sheet, and said third sheet as a CF sheet.

20. A pad as recited in claim 1 in combination with two other like pads arranged side-by-side therewith in a "three to view" format, said securing means comprising common securing means for securing together all margins of record sheets in all of said pads.

* * * * *